US005249444A

United States Patent [19]

Dancs

[11] Patent Number: 5,249,444

[45] Date of Patent: Oct. 5, 1993

[54] DOOR ASSEMBLY INCLUDING SWIVEL LATCH

[75] Inventor: Imre J. Dancs, Greendale, Wis.

[73] Assignee: Master Lock Company, Milwaukee, Wis.

[21] Appl. No.: 695,491

[22] Filed: May 2, 1991

[51] Int. Cl.[5] ..... E05B 17/04

[52] U.S. Cl. ..... 70/380; 70/422; 70/449; 70/466; 292/DIG. 64

[58] Field of Search ..... 70/380, 422, 449, 461, 70/462, 466, DIG. 42, DIG. 62, DIG. 60, 379 R, 379 A; 292/169.23, 244, 245, DIG. 52, DIG. 53, DIG. 60, DIG. 64, 169

[56] References Cited

U.S. PATENT DOCUMENTS

| | | | |
|---|---|---|---|
| 405,057 | 6/1889 | Taylor | 70/379 R |
| 477,036 | 6/1892 | Williams | 70/379 R |
| 963,632 | 7/1910 | Nefflen et al. | 70/379 R |
| 1,917,438 | 7/1933 | Devereaux | 292/DIG. 52 X |
| 2,032,765 | 3/1936 | Rolph | 70/380 |
| 2,213,261 | 9/1940 | Segal | 70/461 |
| 2,929,649 | 3/1960 | Coe | 292/337 |
| 3,048,436 | 8/1962 | Schiowitz | 292/337 |
| 3,853,341 | 12/1974 | MacDonald | 292/353 X |
| 4,080,813 | 3/1978 | McKann | 70/461 X |
| 4,100,774 | 7/1978 | Solovieff et al. | 70/380 |
| 4,489,576 | 12/1984 | Mullich et al. | 70/134 |

FOREIGN PATENT DOCUMENTS

| | | | |
|---|---|---|---|
| 301581 | 11/1917 | Fed. Rep. of Germany | 70/DIG. 60 |
| 367113 | 1/1923 | Fed. Rep. of Germany | 70/462 |
| 562341 | 5/1957 | Italy | 70/DIG. 60 |
| 8570 | 3/1923 | Netherlands | 70/449 |
| 2063981 | 6/1981 | United Kingdom | 70/DIG. 60 |

*Primary Examiner*—Lloyd A. Gall

*Attorney, Agent, or Firm*—Pennie & Edmonds

[57] ABSTRACT

A door assembly having a cylinder plug tailpiece including a swivel latch with passageways, such swivel and passageways being located so that assembly of lock tailpieces cannot be assembled out of phase. The passageways have frangible ends to assist in assembly and permit installation of the assembly on a narrow door. The assembly has temporary assembly arrangement including spring clip-groove pieces that accomplish temporary attachment of assembly halves during installation.

1 Claim, 9 Drawing Sheets

DOOR ASSEMBLY INCLUDING SWIVEL LATCH

BACKGROUND OF THE INVENTION

Prior lock assemblies have proposed means for readily engaging two lock portions as assembled on a door (U.S. Pat. Nos. 671,943 and 3,853,341) but such arrangements have not been found satisfactory as to ease of assembly to accomplish temporarily holding lock halves together while permanent fastening is accomplished nor satisfactory to provide tamper resistance.

Survival latch locks have also been capable of assembly out of phase.

SUMMARY OF THE INVENTION

Broadly, the present invention comprises a key-operated door lock assembly including two lock portions which when assembled have rigidity and are shaped to capture a swivel-operated latch in such a manner that the latch, as installed in the door, assists in resisting torquing or otherwise tampering with the lock assembly. The assembly of the lock portions, each having tailpieces, is assisted by placing apertures in either upper or lower hemispheres of the rotatable base of the latch swivel and by placing the base swivel at non-equidistant between upper latch edge of lower latch edge to prohibit assembly when the latch is upside down.

It is a feature of the invention that the lock portions are temporarily held together by both friction and spring clip action while final engagement with threaded screws is accomplished.

It is also a feature that the tailpiece-receiving passageway in the swivel has breakaway end walls to discourage entering the tailpiece in the incorrect passageway during assembly but allowing the tailpiece to exit the passageway when assembly is made on a narrow door.

It is a feature that the tailpiece and latch swivel aperture are both configured with a common shape to assist in assembly.

BRIEF DESCRIPTION OF THE PREFERRED EMBODIMENT

Figure 1:
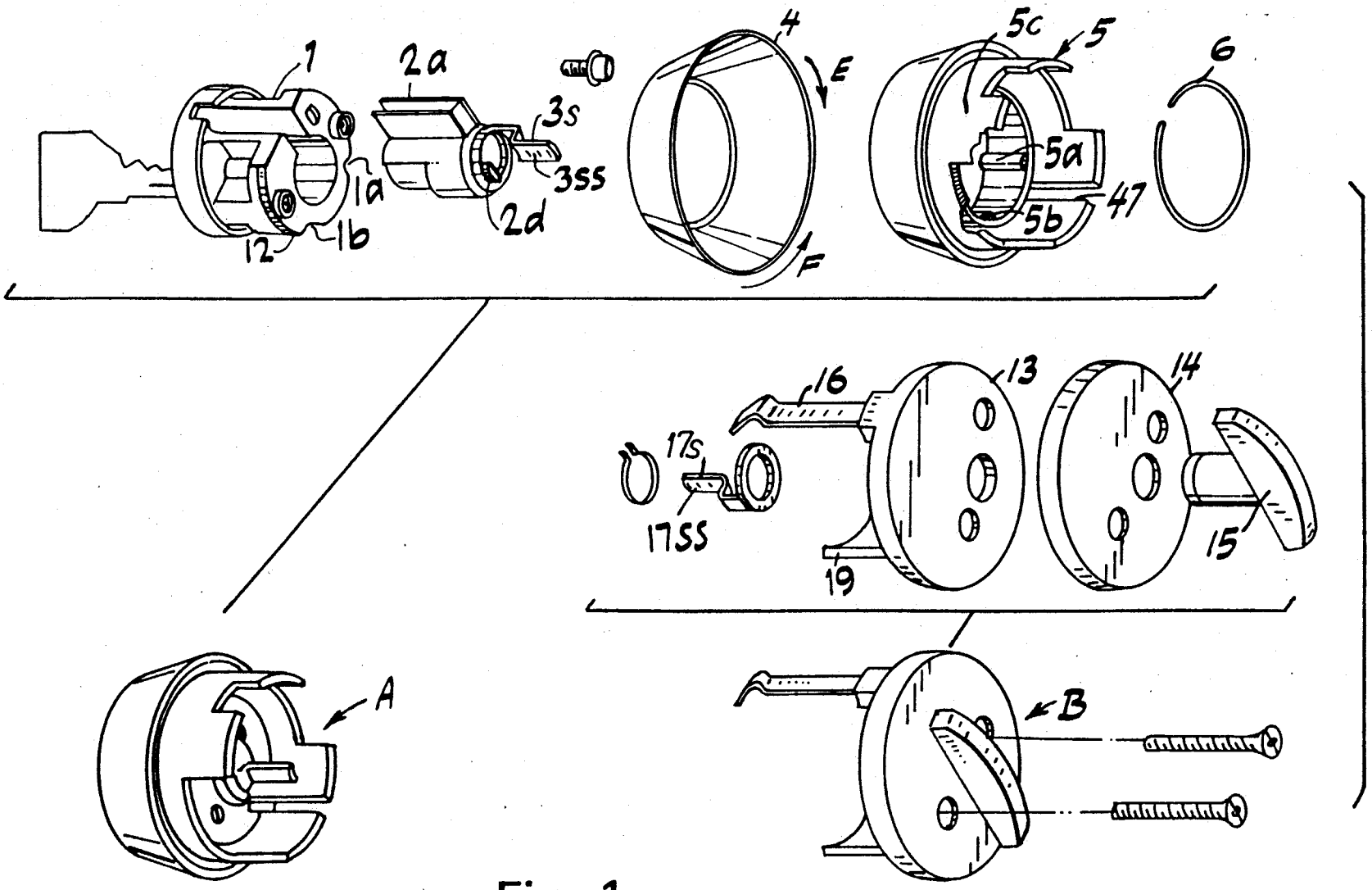
FIG. 1 is an exploded perspective view of portions A and B of the lock assembly.
Figure 1A:
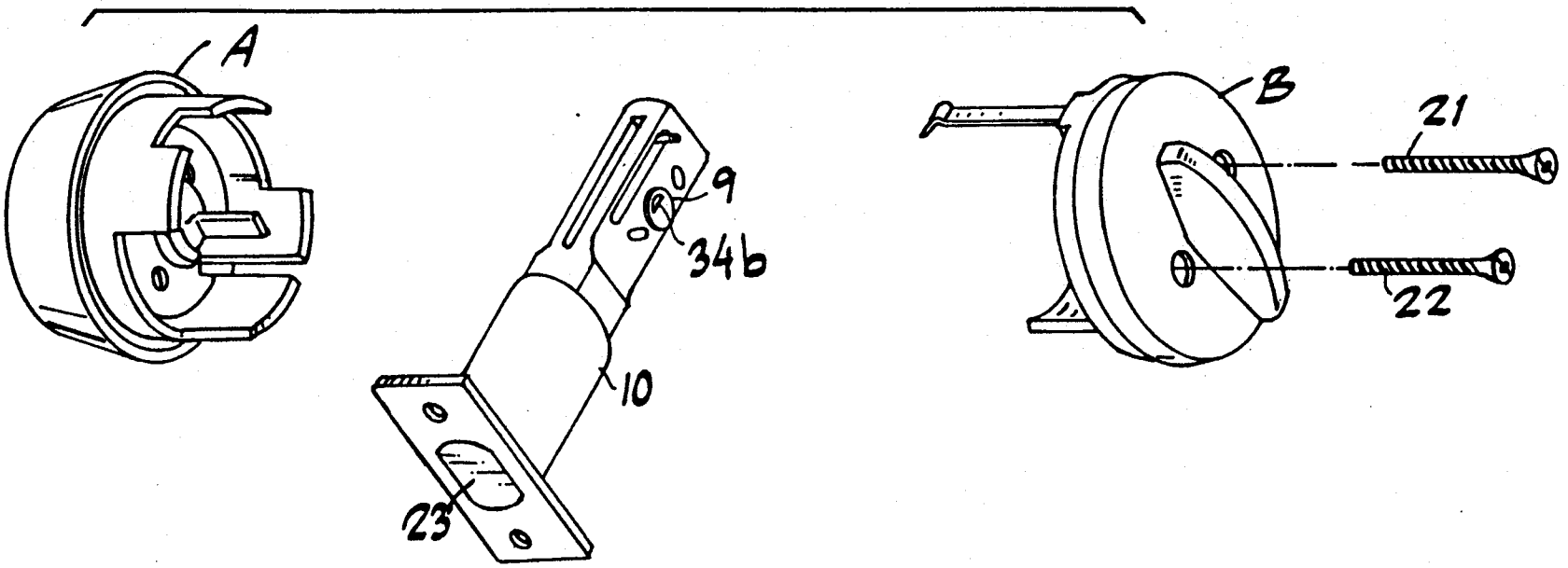
FIG. 1*a* is an exploded view showing the assembled portions and the latch.
Figure 1B:
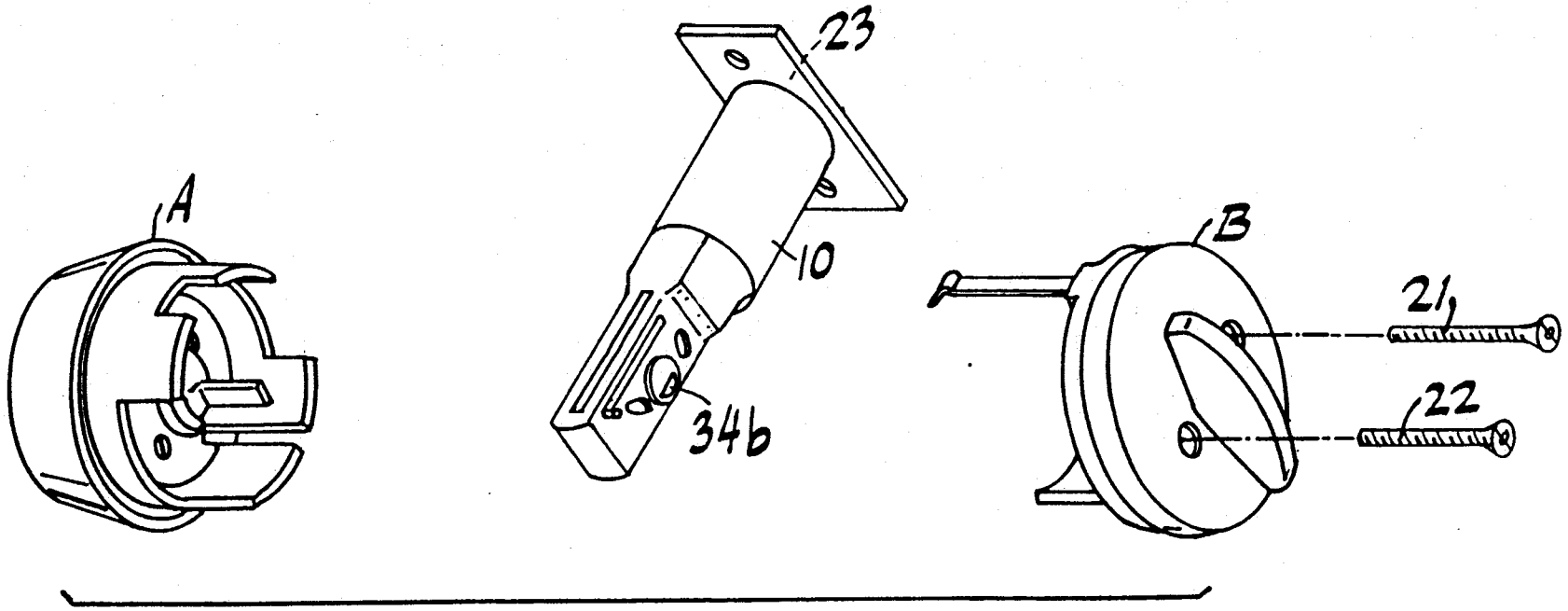
FIG. 1*b* is a view similar to FIG. 1*a* with the latch oriented for assembly on the opposite side.

In FIGS. 1, 1*a* and 1*b* lock cylinder housing 1, forming part of lock portion A, has cylinder plug 2*a* carrying key lock L-shaped tailpiece 3 mounted on rotatable ring 3*a*. D-shaped stop 2*d* limits rotation of tailpiece 3. Cylinder housing 1 is assembled into and secured to outer lock housing 5 to prevent turning movement between such housings 1 and 5. Rotatable movement, movement in the direction of arrows C or D in FIG. 3, between housings 1 and 5 is prevented by housing rails 5*a*, 5*b* and longitudinal lock housing grooves 1*a*, 1*b* which receive such rails 5*a*, 5*b* (FIG. 1). Torquing housing 1 will in turn torque housing 5 which torquing will be resisted by the latch as explained below. Housing 1 is held against withdrawal from housing 5 by use of snap ring 6 which fits into housing groove 12 (see also FIG. 2). When ring 6 is in groove 12 housing 1 cannot be withdrawn from outer housing 5. This assembly portion, preferably accomplished at the factory, comprises lock cylinder portion A. The other lock assembly portion B includes thumb turn cover decorative plate 14, mount plate 13 temporary engagement spring clip 16, projection 19, rotatable thumb piece, L-shaped tailpiece 17 and tailpiece retaining ring 12. Assembly portion B is also preferably assembled at the factory. Portions A and B are assembled and secured to a door and once assembled together with a latch 10 provide completed lock assembly 8 (see FIG. 2).

Turning in particular to FIGS. 1*a* and 1*b*, lock portions A and B are shown in an exploded view along with latch 10 including its swivel 9. The portions are attached using threaded bolts 21, 22. Latch 10 may be assembled for bolt 23 extension to the right (as viewed from the door exterior) or for extension to the left (FIG. 1*b*).

Figure 2:
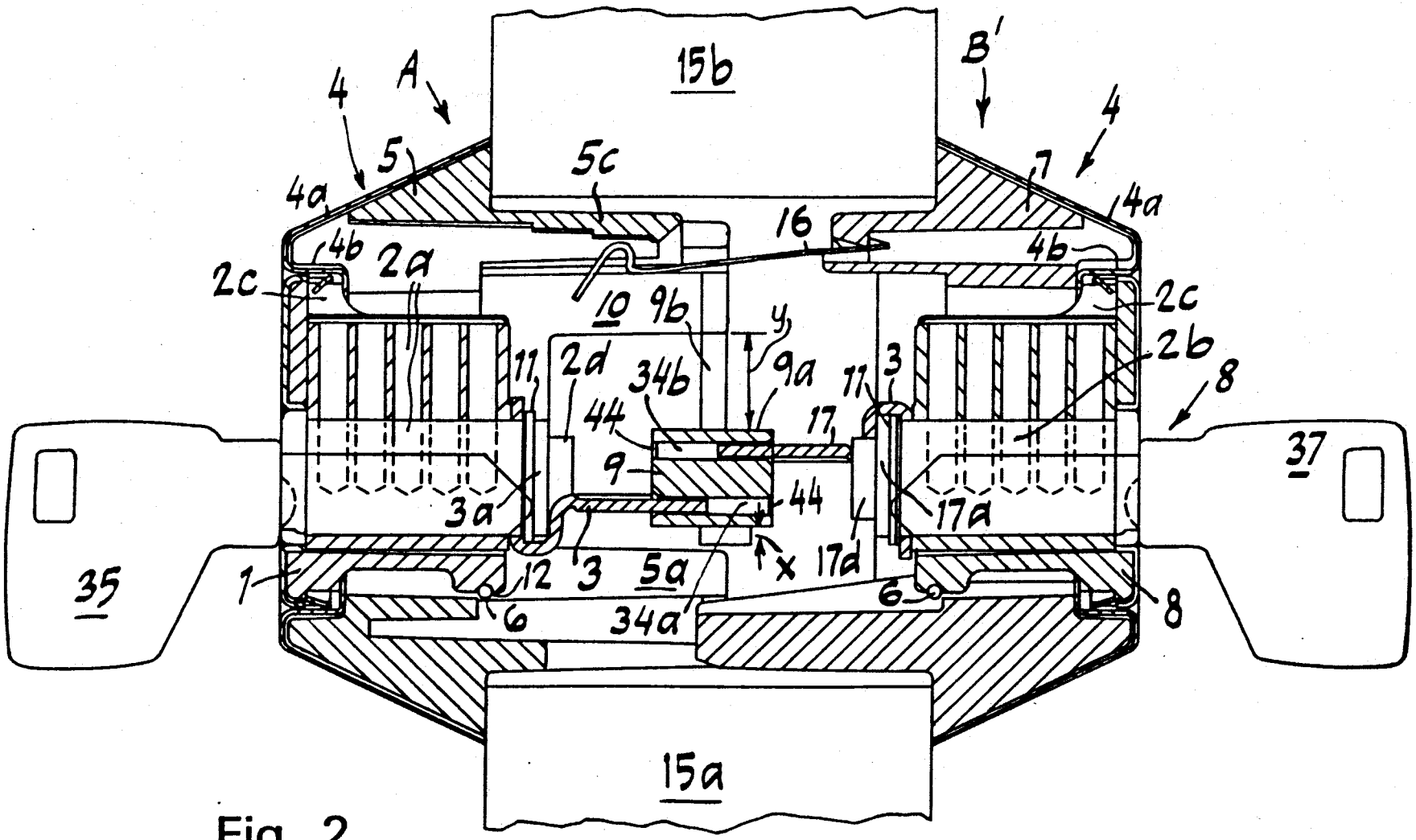
FIG. 2 is an elevational sectional view of the lock assembly installed in a door.

In FIG. 2, an alternative embodiment is shown in which portion B' includes an interior lock cylinder plug 2*b* substituted for the thumb turn unit B. In this view, latch 10 is positioned for bolt 23 extension to the right as viewed from the exterior. Lock portion A is the outside lock portion. Swivel rotatable base 9*a* has a lower passageway 34*a* serving outside tailpiece 3 and an upper passageway 34*b* serving inside rotatable tailpiece 17. Tailpiece 17, like tailpiece 3, has a D-shaped stop 17*d* limiting the rotation of tailpiece 17. Tailpieces 3, 17 include mounting collars 3*a* and 17*a* which rotate about cylinder plugs 2*a* and 2*b* so that tailpieces 3, 17 can be inserted into passageways 34*a*, 34*b* whether latch 10 is installed left or right. Cylinder plugs 2*a*, 2*b* rotate by key action about longitudinal axes parallel to the axis of rotation of swivel 9. Further, tailpieces 3, 17 can only be assembled in proper phase. This overcomes a problem in prior art locks. Passageways 34*a*, 34*b* are located in upper and lower hemispheres 9*uh*, 91*h* of swivel base 9*a* and each passageway preferably has a configuration which complements the shape of tailpieces 3, 17. Configuration can differ as long as turning of tailpiece turns the swivel when the two are engaged. To permit withdrawal of a lock key only in the unlock (or deadbolt withdrawal position), it is important that tailpieces 3, 17 be properly positioned during assembly. For example, in prior locks if a tailpiece is oriented 180° out of phase during assembly, the key can be withdrawn only when the lock is unlocked. This invention provides a solution to this problem by making such assembly impossible by locating the swivel passageways in upper and lower hemispheres and by placing the swivel base non-equidistant from the latch edges 10*a*, 10*b*, all as further explained. Tailpieces 3, 17 each have cross-sections including two (2) spaced apart curves 3*s*, 3*ss* and 17*s*, 17*ss*.

Also shown are inner bolt housing 7, outside key 35, inside key 37, snap ring 6 in groove 12, upper and lower door portions 15*a*, 15*b*, conical spin rings 4, and temporary engagement spring clip 16. Further, there is shown engagement spring clip 16 and outer cylindrical housing shroud 5*c* the operation of which is explained further below.

Spin rings 4 include angled decorative shield portions 4*a* and shaped bearing portions 4*b* which ride on housing ledges 2*c*. Rings 4 spin around housing 5 when a torque is applied in either direction of arrows E and F (see FIG. 1).

Figure 3:
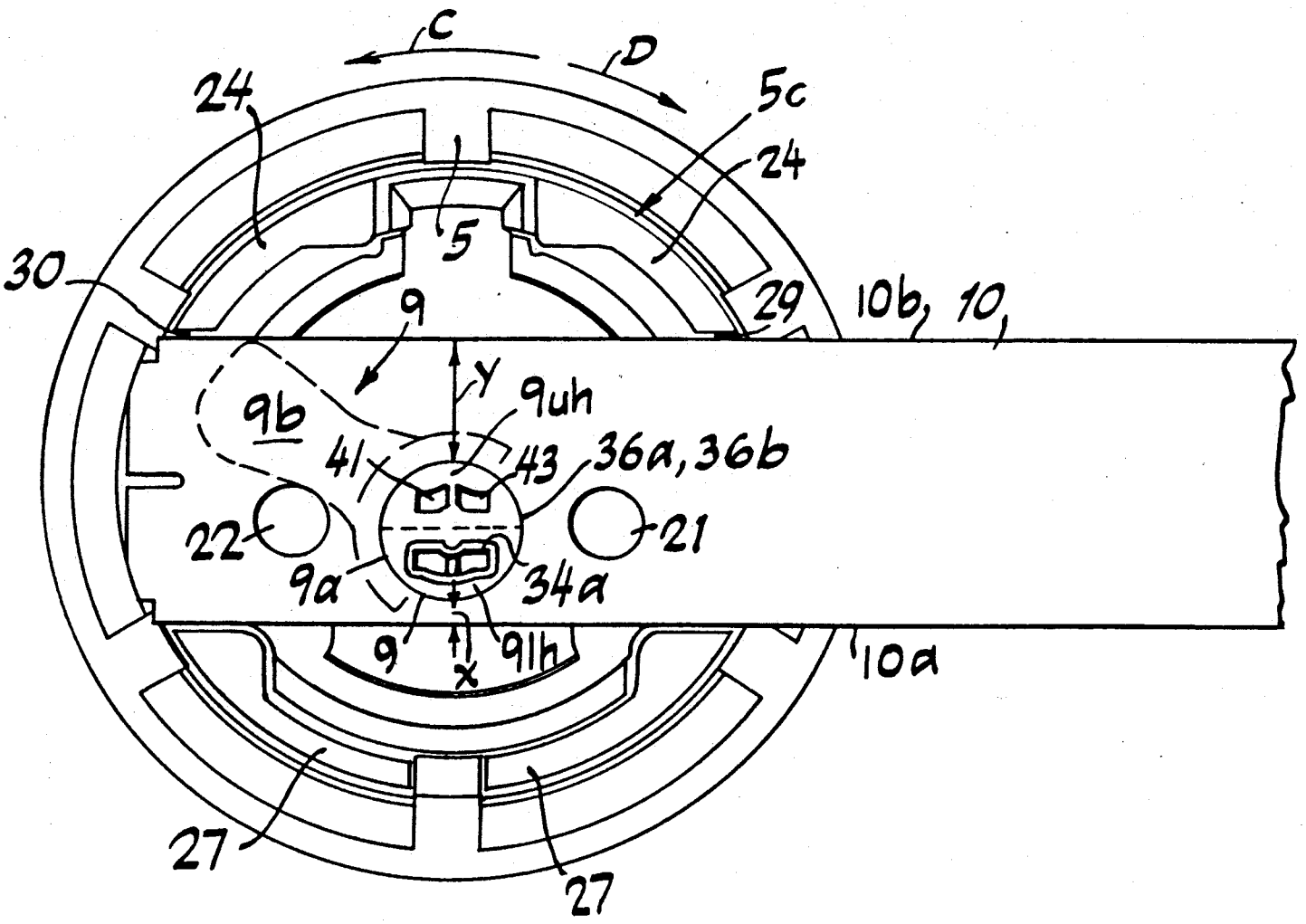
FIG. 3 is an elevational sectional view showing a portion of the lock assembly and the latch.

With respect to FIG. 3, outer deadbolt housing 5 includes cast cylindrical shroud 5*c* having upper shroud portion 24 and lower shroud portion 27. Latch 10 is nested between upper shroud portion 24 and lower shroud portion 27 with small upper clearance spaces 29, 30 adjacent latch edge 10*b*. Clearances may be adjacent edge 10*a* or adjacent both edges 10*a*, 10*b*. Torquing of shroud 5*c* by a tamperer in either direction of arrow C or D will cause shroud 5*c* to strain or deflect until it contacts an edge 10*a*, 10*b* of latch 10 and further shroud 5*c* rotation will be arrested by latch 10 as well as bolts, 21 and 22. Latch 10 which is stronger than bolts 21 and 22, will as nested in close proximity with small clearances from shroud 5*c*, assist in preventing the breaking or shearing of bolts 21, 22 and resulting compromising of lock security. Also shown are configured passageway 34*a* in lower hemisphere 91*h* of rotatable swivel base 9*a*. Circular swivel base 9*a* rotates in aligned round openings 36*a*, 36*b* in latch 10. Openings 36*a*, 36*b* are closer to bottom latch edge 10*a* than upper edge latch edge 10*b*. Thus, distance X is shorter than distance Y. Openings 34*a*, 34*b* are shaped with upper and lower curved sides to receive a complementary curved tailpiece 3 or 17 but any shape may be used provided the tailpiece and its opening will accept tailpiece 3 or 17 for turning when latch 10 is properly oriented. Also shown is swivel handle 9*b*.

Two small holes 41, 43 function to further weaken the thin end portion wall 44 of passageway 34*b* in upper hemisphere 9*uh*. Each passageway 34*a*, 34*b* has such a frangible thin end wall portion 44 (FIG. 2). This arrangement permits tailpieces 3, 17 to be inserted in and forced through wall 44 and out of the passageway when installations are made on narrow doors. The presence of walls 44 during initial assembly, as parts are located and oriented, assists in preventing incorrect assembly because it discourages the installer attempting to insert a tailpiece at that location.

Figure 4:
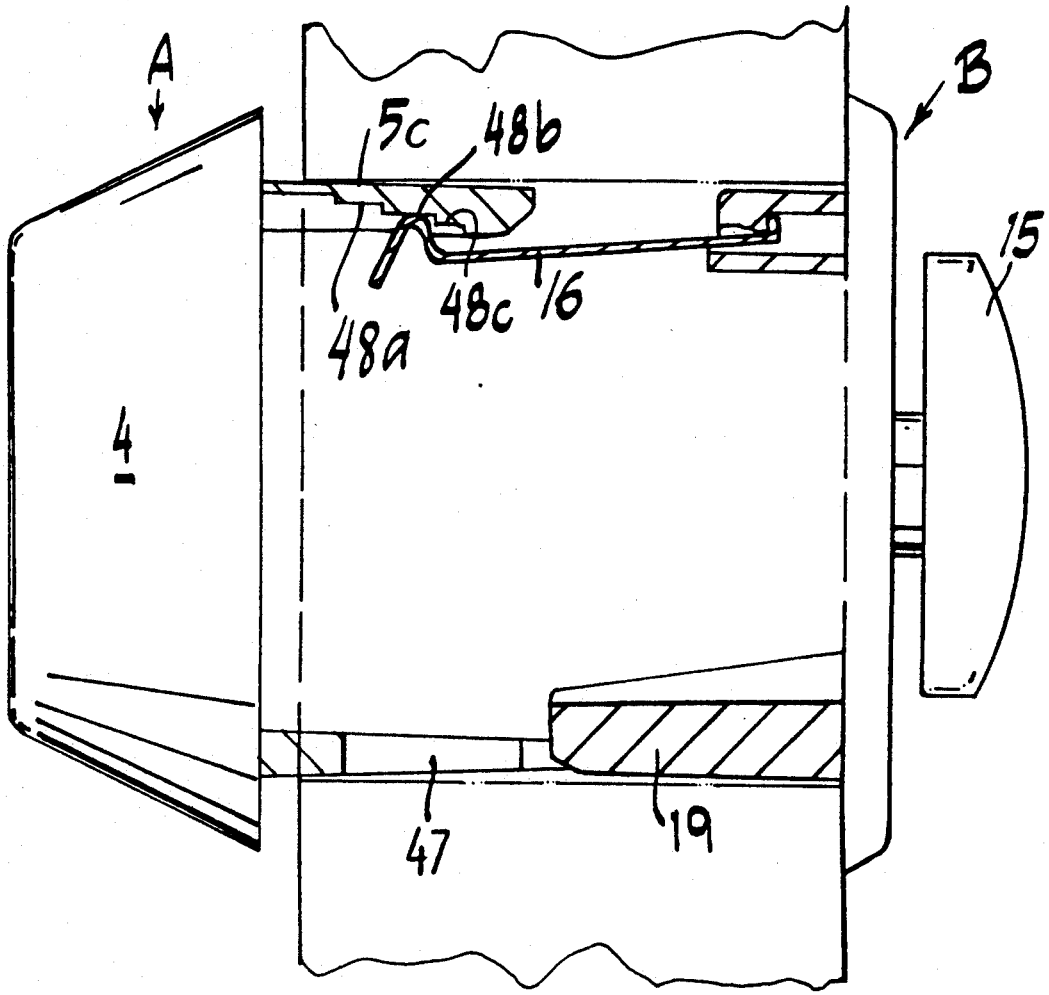
FIG. 4 partial elevational view showing the assembly lock portions during installation.

In FIG. 4, the first embodiment is again shown with inner portion B carrying projection 19 on its lower portion which projection 19 is receivable in slot opening 47 of portion A. Spring clip 16 is also shown engaging internal step 48*b* of step series 48*a–c* in shroud 5*c* of lock portion A. During such temporary engagement, bolts 21, 22 are installed.

Figure 5A:
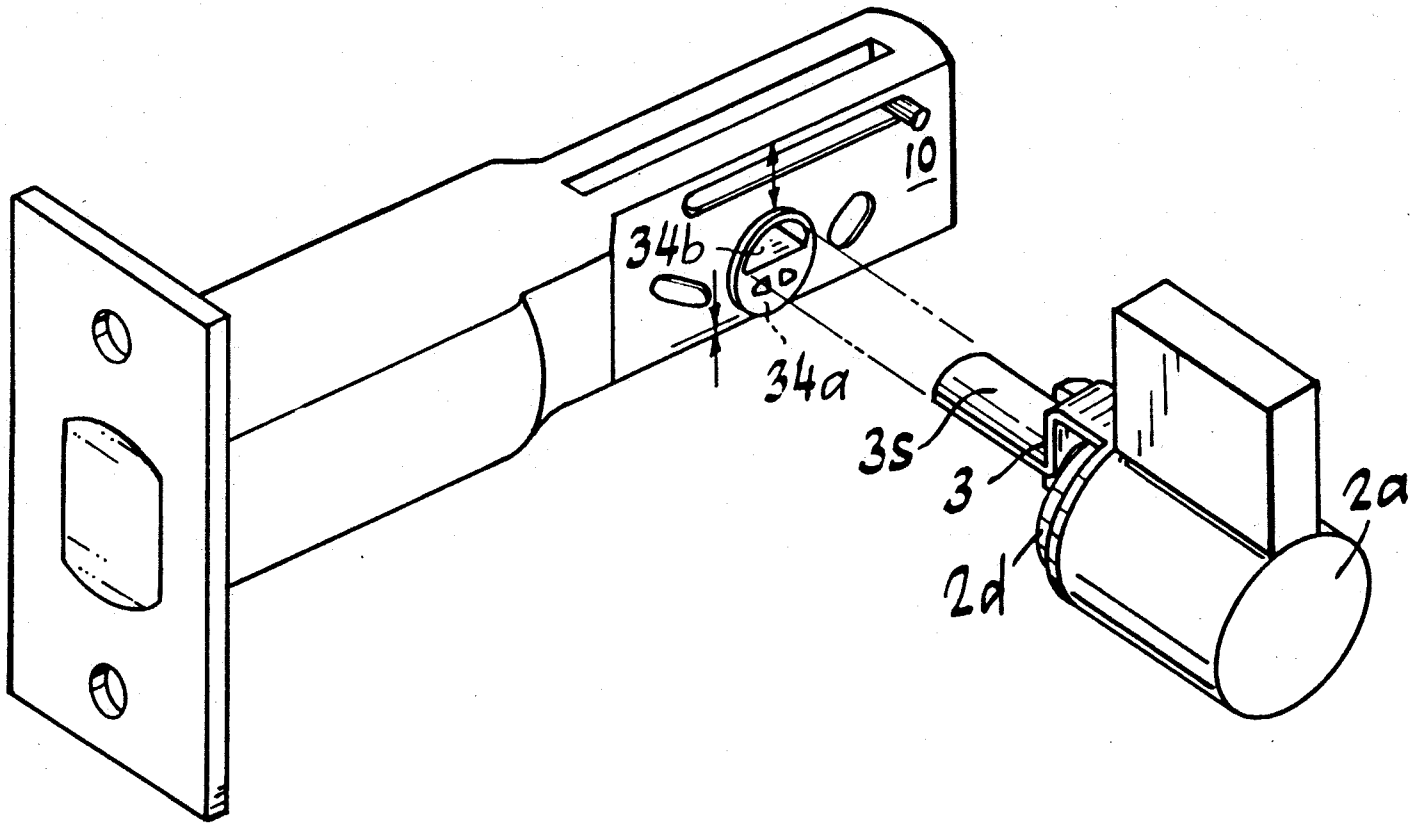
FIG. 5*a* is an enlarged perspective view of the latch in one position with the swivel located to receive the curved cylinder lock tailpiece in the upper hemisphere of the swivel.
Figure 5B:
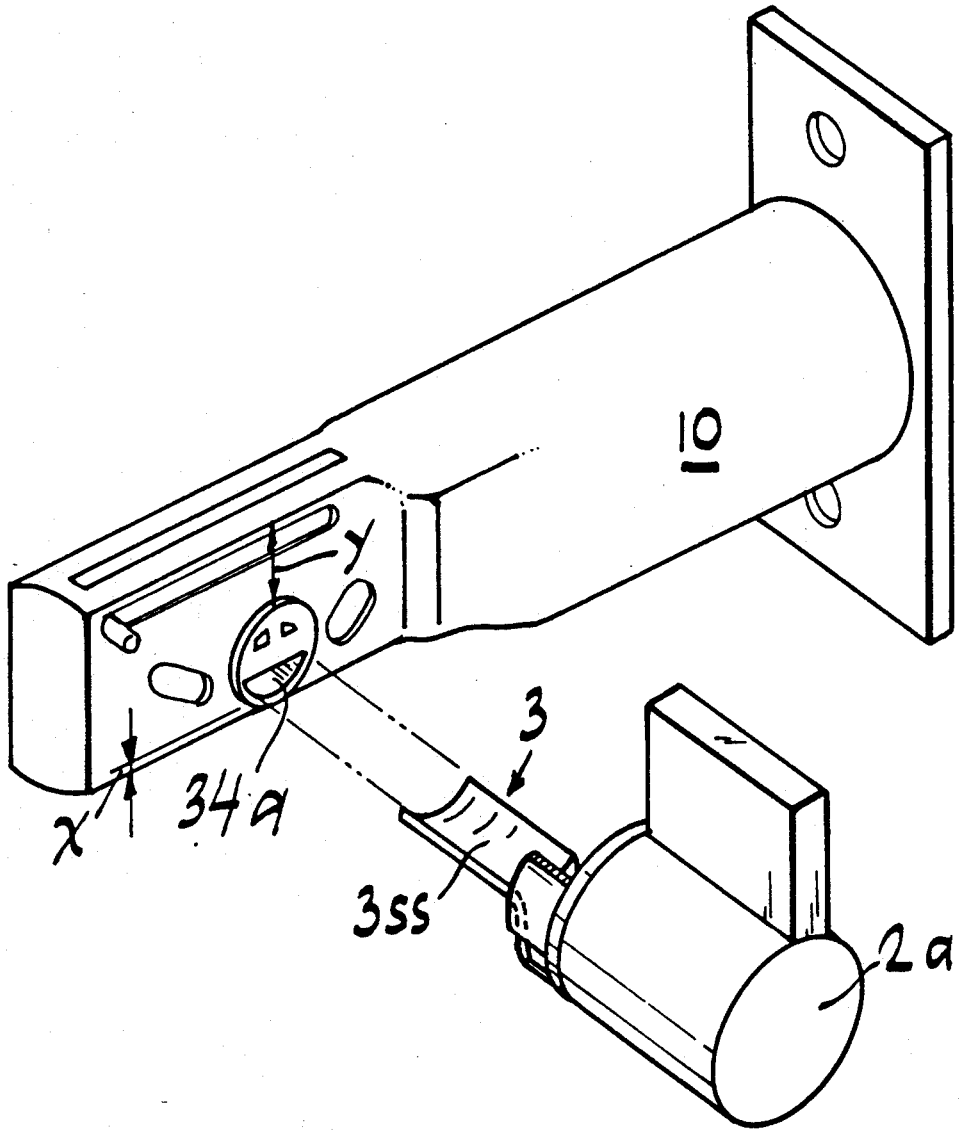
FIG. 5*b* is an enlarged perspective view with the latch in the opposite position with the tailpiece rotated to engage the swivel in the lower hemisphere.
Figure 6:
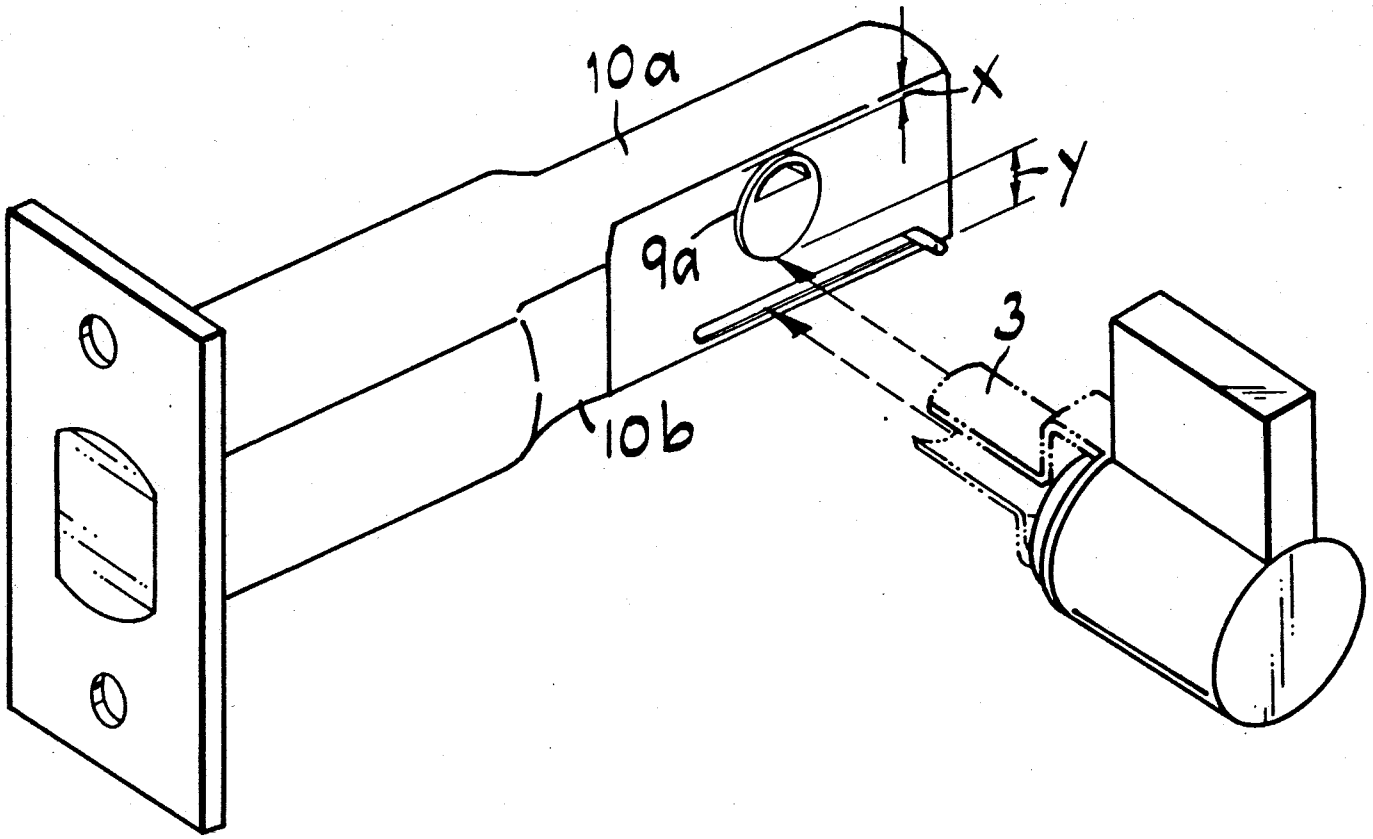
FIG. 6 is a perspective view showing an attempt to assemble the latch upside down showing the tailpiece out of alignment with any passageway.

Finally, with attention to FIGS. 5*a*, 5*b* and 6, L-shaped lock tailpiece 3 with an arcuate shape is rotatable through more than 180° and less than 360° as limited by stationary D-shaped stop 2*d* (FIGS. 1 and 2). As oriented within this limited turning range, tailpiece 3 can be inserted into upper passageway 34*b* or lower passageway 34*a* with tailpiece 3 remaining in proper phase with lock cylinder operation and proper key withdrawal sequence. FIG. 6 illustrates the fact that, if latch 10 is attempted to be assembled upside down, the tailpiece 3 will not be insertable and the installer will see his or her error or complete the proper installation by trial and error

I claim:

1. A key-operated door lock assembly comprising an outer lock portion including a cylinder housing in turn including a lock cylinder which cylinder is rotatable about a longitudinal axis, an inner lock portion and a latch having upper and lower edges and a swivel with a round swivel base therein, the improvement comprising a) a first configured tailpiece on the lock cylinder, a second tailpiece on the inner lock portion with both tailpieces rotatable about said longitudinal axis;

b) a circular opening in the latch a selected distance from the lower edge of the latch for receiving said swivel base;

c) said swivel base having an upper hemisphere and a lower hemisphere therein;

d) a complementary configured tailpiece receiving passageway in each hemisphere each of which passageways does not communicate with the other passageway, one of which receiving passageways has an open first end and a frangible closed second end portion to discourage placing a tailpiece in the second end portion but permitting a tailpiece already in a passageway to exit the second end upon breaking such end portion.

* * * * *